US005615497A

United States Patent [19]

Meschan

[11] Patent Number: 5,615,497

[45] Date of Patent: Apr. 1, 1997

[54] ATHLETIC SHOE WITH IMPROVED SOLE

[76] Inventor: David F. Meschan, 502 Waycross Dr., Greensboro, N.C. 27410

[21] Appl. No.: 108,065

[22] Filed: Aug. 17, 1993

[51] Int. Cl.[6] ..... A43B 21/36; A43B 3/24; A43C 13/00

[52] U.S. Cl. ..... 36/36 R; 36/15; 36/100; 36/105; 36/36 A; 36/36 C; 36/42; 36/31

[58] Field of Search ..... 36/15, 100, 101, 36/103, 105, 36 R, 36 A, 36 C, 41, 42, 27, 31, 35 R, 25 R

[56] References Cited

U.S. PATENT DOCUMENTS

| | | | |
|---|---|---|---|
| 48,682 | 7/1865 | Hayward et al. . | |
| 221,592 | 11/1879 | Mitchell et al. . | |
| 652,887 | 7/1900 | Butterfield | 36/41 |
| 789,089 | 5/1905 | Frank | 36/36 A |
| 818,861 | 4/1906 | Beck et al. . | |
| 1,062,338 | 5/1913 | Kane | 36/36 R |
| 1,318,247 | 10/1919 | Victor | 36/15 |
| 1,346,841 | 7/1920 | Padden . | |
| 1,410,064 | 3/1922 | Hunt | 36/15 |

(List continued on next page.)

FOREIGN PATENT DOCUMENTS

| | | | |
|---|---|---|---|
| 693394 | 7/1940 | Germany | 36/36 A |
| 2154951 | 5/1973 | Germany | 36/134 |
| 2742138 | 3/1979 | Germany | 36/42 |
| 434029 | 10/1967 | Switzerland | 36/36 R |
| 3342 | 2/1911 | United Kingdom | 36/42 |
| 229884 | 3/1924 | United Kingdom . | |
| 1540926 | 2/1979 | United Kingdom | 36/35 A |
| 2144024 | 2/1985 | United Kingdom . | |

*Primary Examiner*—Marie D. Patterson
*Attorney, Agent, or Firm*—Finnegan, Henderson, Farabow, Garrett & Dunner

[57] ABSTRACT

An improved athletic shoe sole with rotatable and replaceable rear soles and replaceable cleats to provide the user with longer wear. The invention also provides the user with the ability to quickly and easily adapt the sole to different desired performance characteristics depending upon the intended activity and terrain or playing surface.

15 Claims, 5 Drawing Sheets

U.S. PATENT DOCUMENTS

| | | | |
|---|---|---|---|
| 1,439,757 | 12/1922 | Redman . | |
| 1,439,758 | 12/1922 | Redman . | |
| 1,458,257 | 6/1923 | Van Melle . | |
| 1,479,773 | 1/1924 | Craig . | |
| 1,516,384 | 11/1924 | Kamada . | |
| 1,542,174 | 6/1925 | Robidoux . | |
| 1,611,024 | 12/1926 | Grimaldi . | |
| 2,002,087 | 5/1935 | Esterson . | |
| 2,208,260 | 7/1940 | Hayden . | |
| 2,288,168 | 6/1942 | Leu | 36/36 R |
| 2,300,635 | 11/1942 | Shepherd . | |
| 2,374,954 | 5/1945 | Pipitone . | |
| 2,500,302 | 3/1950 | Vicente . | |
| 2,540,449 | 2/1951 | Kaufmann | 36/105 |
| 2,556,842 | 6/1951 | Gilmour . | |
| 2,607,134 | 3/1952 | Langer | 36/59 |
| 2,628,439 | 2/1953 | Rochlin | 36/36 R |
| 2,707,341 | 5/1955 | Romano | 36/42 |
| 2,745,197 | 11/1956 | Holt | 36/2.5 |
| 2,806,302 | 9/1957 | Sharpe . | |
| 2,998,661 | 9/1961 | Israel | 36/35 R |
| 3,085,359 | 4/1963 | Rubens . | |
| 3,087,265 | 4/1963 | McKinley | 36/35 R |
| 3,208,163 | 9/1965 | Rubens . | |
| 3,237,321 | 3/1966 | McKinley . | |
| 3,271,885 | 9/1966 | McAuliffe | 36/42 |
| 3,318,025 | 5/1967 | Antelo | 36/36 B |
| 3,478,447 | 11/1969 | Gillead | 36/36 R |
| 3,514,879 | 6/1970 | Frattallone . | |
| 3,566,489 | 3/1971 | Morley | 36/67 |
| 3,646,497 | 2/1972 | Gillikin . | |
| 3,664,041 | 5/1972 | Frattallone . | |
| 3,775,874 | 4/1973 | Bonneville | 36/67 |
| 3,782,010 | 1/1974 | Frattallone . | |
| 3,928,881 | 5/1975 | Bente | 12/142 |
| 4,062,132 | 12/1977 | Klimaszewski | 36/100 |
| 4,098,011 | 8/1978 | Bowerman | 36/129 |
| 4,214,384 | 7/1980 | Gonzalez . | |
| 4,262,434 | 9/1981 | Michelotti | 36/67 |
| 4,263,728 | 10/1981 | Frecentese | 36/129 |
| 4,267,650 | 3/1981 | Bauer | 36/101 |
| 4,322,894 | 2/1982 | Dykes | 36/114 |
| 4,363,177 | 12/1982 | Boros . | |
| 4,377,042 | 4/1983 | Bauer | 36/101 |
| 4,378,643 | 4/1983 | Johnson | 36/129 |
| 4,393,605 | 11/1983 | Spreng | 36/114 |
| 4,414,763 | 11/1983 | Bente | 36/134 |
| 4,429,474 | 2/1984 | Metro | 36/42 |
| 4,455,766 | 6/1984 | Rubens . | |
| 4,541,185 | 10/1985 | Chou | 36/114 |
| 4,598,487 | 3/1986 | Misevich | 36/114 |
| 4,606,139 | 8/1986 | Silver | 36/15 |
| 4,608,768 | 4/1986 | Cavanagh | 36/28 |
| 4,610,100 | 9/1986 | Rhodes . | |
| 4,706,392 | 2/1987 | Yang | 36/101 |
| 4,745,693 | 1/1988 | Brown | 36/101 |
| 4,875,300 | 2/1989 | Kazz | 36/134 |
| 4,887,367 | 3/1989 | Mackness et al. | 36/28 |
| 4,936,028 | 6/1990 | Posacki | 36/15 |
| 4,979,319 | 6/1990 | Hayes | 36/117 |
| 4,995,173 | 2/1991 | Spier | 36/29 |
| 5,005,300 | 11/1991 | Diaz et al. | 36/114 |
| 5,083,385 | 2/1992 | Halford | 36/101 |
| 5,092,060 | 3/1992 | Frachey et al. | 36/29 |

ATHLETIC SHOE WITH IMPROVED SOLE

FIELD OF THE INVENTION

The present invention relates generally to an athletic shoe with an improved sole and, more particularly, to an athletic shoe with an extendable and more versatile life due to the ability of the user to replace or adjust portions of the outer sole of the shoe.

BACKGROUND OF THE INVENTION

Athletic shoes are becoming more expensive each year. Top-of-the-line models of the leading manufacturers can now sell for more than one hundred dollars a pair. The likelihood is that shoes will continue to become even more expensive in the years ahead as technology and performance continue to improve.

Fortunately, improvements in some features have accompanied the cost increases. Wear spots on the shoe upper have been reinforced with leather. Stitching is better and seldom unravels. Glues and molding techniques are improved, meaning that the soles are less prone to separate during use. Padding around the ankle collar and on the tongue has improved comfort. Natural and man-made fabrics are more durable and stretchproof. New elastomer components have been employed for improved heel support and eyelet strength. Replaceable insoles mold to the shape of the foot for added comfort. Heel-cushioning methods have received great attention from manufacturers and, aside from improving comfort, have reduced the risk of injury.

One area, however, in which technology has not kept pace is tread wear. For example, the tread of a good pair of running shoes manufactured in 1993 does not appear to be any more durable than the tread on a good pair manufactured in 1983, or for that matter 1973. A user rarely has a choice of running surfaces, and asphalt and other abrasive surfaces take a tremendous toll on the outersole of running shoes. The problem is exacerbated by the fact that the most pronounced tread wear, on running shoes in particular, occurs principally in two places: the outer periphery of the heel, and the ball of the foot. Heel wear is by far the more acute problem. This is understandable inasmuch as the impact force on the heel of a jogger, for example, has been estimated at about three to four times the weight of the jogger. Thus, a jogger weighing 150 pounds would create a force of 600 pounds of shock on one heel. With each heel impacting the ground approximately 800 times per mile, it is not difficult to understand why the heel of a running shoe is the first part of the shoe to wear out. The fact that this is where support is most needed only serves to compound the problem. Sadly, technological advancements in heel and midsole cushioning and construction largely can be negated by two months of heel wear.

Tread wear on other types of athletic shoes is also a problem. Basketball shoes, cross-trainers, walking and tennis shoes are other examples of athletic shoes which exhibit rapid tread wear in isolated areas or in distinctive patterns.

There appears no product on the horizon that will appreciably enhance the usable life of an athletic shoe's outersole when subjected to the usual abrasive forces. Nor do there appear to be any athletic shoes currently in the marketplace with replaceable soles or replaceable tread elements.

Designs are known that specify the replacement of the entire outersole of a shoe. Examples include those disclosed in U.S. Pat. Nos. 4,745,693 4,377,042 and 4,267,650. These concepts are impractical for most applications, especially athletic shoes, for several reasons. First, tight adherence between the sole and the shoe is difficult to achieve, particularly around the periphery of the sole. Second, replacement of the entire sole is unnecessary based upon typical wear patterns in athletic shoes. Third, replacing an entire sole is or would be more expensive than replacing simply the worn elements, a factor which is compounded if a replaceable, full-length sole for every men's and women's shoe size is to be produced. Finally, it would appear that the heel section, in particular, has entirely different needs and requirements from the rest of the shoe sole, and it deteriorates at a much faster rate.

U.S. Pat. No. 4,262,434 (Michelotti) discloses a sole for running shoes that employs detachable tread elements. However, the design of the replaceable cleats of Michelotti is impractical in many respects. For example, the cleats of Michelotti operate as the male mating elements, with the engaging post and knobs of the cleats pointing upward toward the bottom of the user's foot. This creates an insoluble dilemma. Either the female receptors are formed within a "relatively thick body 14" of the sole, which adds unnecessary thickness, weight and diminished flexibility to both the outersole and midsole in order to house the receptor space for the knob of the cleats; or the protrusion of the cleat knob makes it more likely that the user will feel the cleat knobs on the bottom of his feet, particularly after inevitable midsole deterioration that accompanies extended use. Also, the Michelotti design is simply inadequate for the heel of any athletic shoe, where detachable cleats are more prone to dislodge. The heel area requires a stronger and more durable disengagement system.

SUMMARY OF THE INVENTION

The present invention is directed to an improved athletic shoe comprising an upper, a forward sole attached to the upper, a heel support also attached to the upper, and a rear sole attached to the heel support. The rear sole has a ground engaging surface, one or more side walls, and a top surface. The rear sole is mounted on the heel support so as to be detachably secured therefrom. The rear sole can also be rotatable among a plurality of positions, both along the major axis of the shoe so that the rear sole, is, in effect inverted or "flipped," and along an axis normal to the major axis of the shoe. A means for securing the rear sole in each position and to the heel support is provided. In another embodiment, the forward sole of the athletic shoe has a midsole, a base layer attached thereto, and an outersole attached to the base layer. The outersole contains a plurality of openings, which openings are aligned over a plurality of resilient posts integrally formed onto the base layer. The resilient posts extend downwardly through the outersole openings. A plurality of resilient cleats is detachably secured to the posts, each of the cleats containing a cavity which is sized to receive the corresponding post, and an engaging means so that the cleat is detachably secured to the post formed on the base layer. Additional aspects of the invention are more fully described below.

Accordingly, one object of the present invention is to provide an athletic shoe with replaceable or adjustable bottom sole sections to improve and prolong the useful life of the shoe.

Another object of the present invention is to provide an athletic shoe whereby treadlife can be extended by selectively replacing tread elements without the need to replace the entire sole of a shoe.

Still another object of the invention is to employ mechanisms or techniques that allow the wearer of the shoe to replace the worn sole elements, without having to take the shoe to a retail store or repair shop for service.

A further object of the invention is to provide the user with the ability to change rear soles and/or cleats based on wear or on desired performance characteristics or anticipated terrain or playing surfaces.

Still another object of the invention is to provide an improved athletic shoe that will allow manufacturers to utilize existing technologies and cushioning techniques.

These and other aspects of the present invention will become apparent to those skilled in the art after a reading of the following description of the preferred embodiments when considered with the drawings.

DESCRIPTION OF THE PREFERRED EMBODIMENTS

The drawings are for the purpose of describing a preferred embodiment of the invention and are not intended to limit the present invention.

Figure 1:
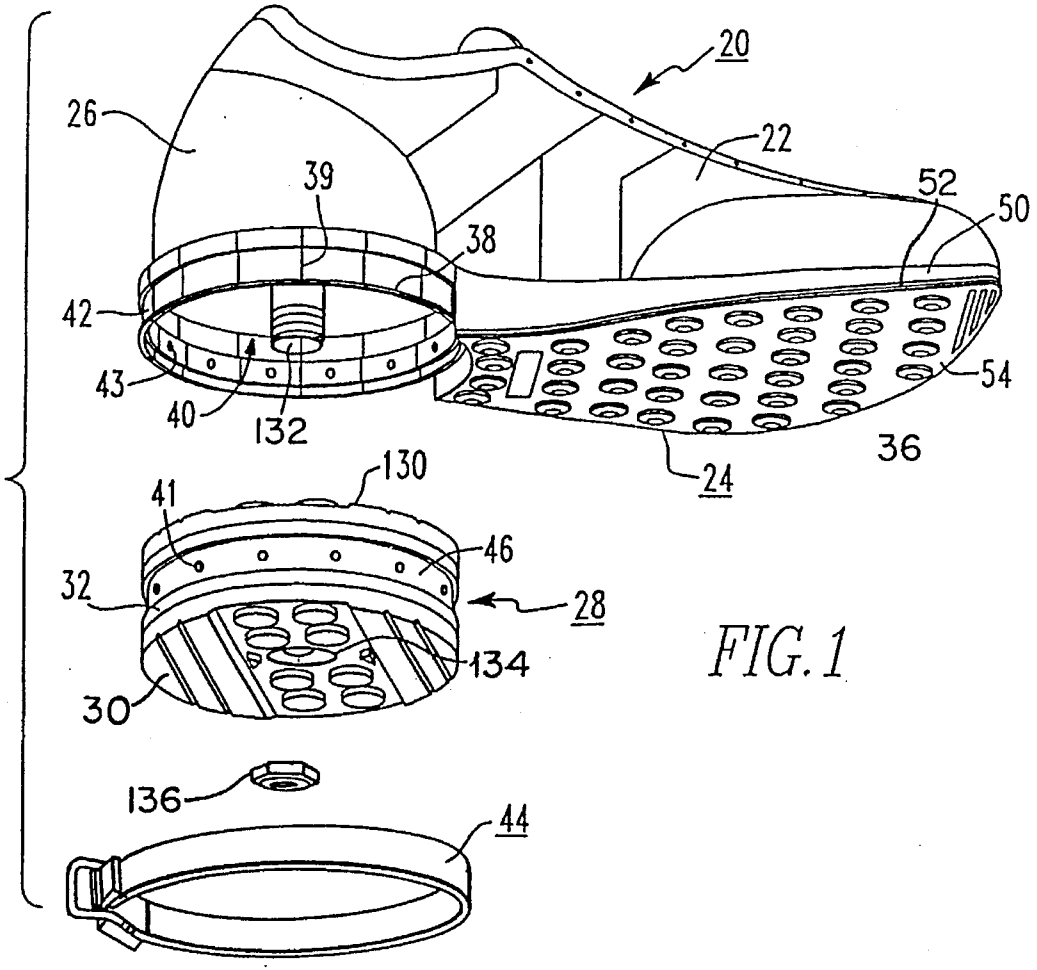
FIG. 1 is an exploded isometric view of an improved athletic shoe sole with a rotatable/replaceable heel and replaceable cleats.

FIG. 1 is an exploded isometric view of an athletic shoe incorporating a rotatable and replaceable rear sole and a plurality of replaceable cleats. The shoe, designated generally as 20, has a shoe upper 22, a forward sole 24, a heel support 26 and a rear sole 28. The forward sole and heel support are attached to the shoe upper in a conventional manner, typically by injection molding, stitching or gluing. The heel support 26 has a side wall 38 that extends downward beyond the upper 22 and defines a recess 40.

The rear sole 28 in its preferred embodiment will be made from three different materials: a rubber compound for a first ground engaging surface 30; a softer, elastomeric material such as polyurethane or ethylene vinyl acetate (EVA) for the midsole 32 of the heel; and a harder plastic material for a notched section 46 that encompasses the horizontal midsection of the rear sole in FIG. 1. (In FIG. 1, the rear sole 28 also has a second ground engaging surface 130, which preferably is also a rubber compound.) However, the rear sole could be comprised of a single homogenous material, or two materials (e.g., EVA enveloped by hard rubber), or any number of layers or combinations of materials, including a material comprising the air encapsulating tubes, for example, disclosed in U.S. Pat. No. 5,005,300.

The rear sole 28 is detachable from the heel support 26. This allows the user the ability to change rear soles entirely when either the sole is worn to a significant degree, or the user desires a different sole for desired performance characteristics for specific athletic endeavors or playing surfaces.

The rear sole 28 can also be rotatably mounted on the heel support 26. The rear sole can be rotated to a plurality of positions (although only 4 positions are possible in the FIG. 1 embodiment), with a means provided to allow the user to secure the rear sole at each desired position. After a period of use, the periphery of the ground engaging surface 30 will exhibit a wear pattern at the point in which the heel first contacts the ground, when the user is running, for example. Excessive wear occurs at this point, degrading the performance of the rear sole. When the user determines that the wear is significant enough, the user detaches the rear sole 28 from the heel support 26, and rotates the rear sole so that the worn portion will no longer be in the location of the user's first heel strike. Rotation can occur in an axis aligned with the major axis of the shoe, so that the heel is in effect "flipped," or can occur about an axis normal to the major axis of the shoe, or any combination of the above. The user then re-engages and secures the rear sole to its new position so that the rear sole will not become dislodged during use. The number of positions into which the rear sole can be rotated is not limited; however, the embodiment depicted in FIG. 1 permits on both axes a total of only 4 such positions due to the elliptical shape of the rear sole.

Rotating the rear sole about an axis normal to the shoe's major axis to a position of, for example, of 180 degrees beyond its starting point, will locate the worn portion of the rear sole at or near the instep portion of the shoe. The instep portion is an area of less importance for tractioning, stability, cushioning and shock absorbing purposes. It is important to note, however, that in embodiments other than that depicted in FIG. 1, the rear sole need not be rotated a full 180 degrees to achieve the benefit of extended use. As long as the worn portion of the rear sole is rotated beyond the area of the initial heel strike, prolonged use of the rear sole is possible. The user can continue periodically to rotate the rear sole so that an unworn portion of the rear sole is located in the area of the first heel strike.

The shape of the rear sole 28 can be circular, polygonal, elliptical, "sanddollar," elongated "sand-dollar" or otherwise. Preferably, the rear sole is shaped so that the rear edge of the ground engaging surface 30 has a substantially identical profile at each rotated position. To allow for a plurality of rotatable positions, the shape of the ground engaging surface 30 preferably should be symmetrical about at least one axis. The ground engaging surface 30 can be planar or non-planar. Preferably, the rear and forward edges of the ground engaging surface on running shoe models will be tapered or beveled, as shown in FIG. 1, to soften heel strike during use.

A plurality of compression slits 39 which run generally vertically around the periphery of the side wall 38 may be included and are shown in FIG. 1. The slits may create a void completely through the side wall 38, or they may merely be a weakened area of the side wall, so that the side wall thickness in the area of the slit is less than the side wall thickness elsewhere.

A threaded stud 132 may be located in the center of the recess 40 of the heel support, as shown in FIG. 1. The stud 132 passes through an aperture 134 of the rear sole 28, and is secured with a threaded collar 136. The aperture 134 is recessed or countersunk so that the collar 136 when secured does not extend beyond the first ground engaging surface 30.

When rotation of the rear sole 28 of FIG. 1 is desired, the user disengages the collar 136, releases the band 44, slides the rear sole off of the threaded stud 132, "rotates" the rear sole, slides the rear sole back on the threaded stud, and resecures the band and collar. The rear sole of FIG. 1 is sized to allow rotation about two axes of the shoe. In addition to being rotatable about a first axis, which is normal to the major axis of the shoe, the rear sole of FIG. 1 is invertible, meaning that the sole can be rotated about a second axis that is aligned with the major axis of the shoe. In order to be invertible, the rear sole must have a first ground engaging surface 30 located opposite a second ground engaging surface 130. When the user desires to change the ground engaging surface entirely, instead of merely rotating the worn spot about an axis normal to the shoe's major axis, the user detaches the rear sole and inverts it, and the first ground engaging surface 30 assumes the relative position of the second ground engaging surface 130, and vice-versa. Of course, the user could rotate the rear sole about both axes at the same time, if desired, when the rear sole is disengaged and re-engaged.

The side wall 38 further contains a first notched section 42 that extends generally horizontally along the entire periphery of the side wall 38. A securing band 44 fits around the side wall 38 of the heel support and within the first notched section. Both ground engaging surfaces of the rear sole 28 are sized to fit within and mate with the recess 40 of the heel support 26 when assembled, The horizontal mid-section of the rear sole 28 has a second notched section 46 along its periphery, and is sized to fit within and mate with the first notched section 42. After the rear sole is placed up within the recess of the heel support, the securing band 44 fits within the first notch 42 and, upon tightening, securely holds the rear sole 28 in place during use. The compression slits 39 allow the side wall 38 of the heel support 26 to be compressed when the securing band 44 is tightened, ensuring a snug and secure fit.

Located on the interior surface of the first notched section 42 is a plurality of alignment dimples 43. A plurality of alignment nipples 41 are located at corresponding positions on the exterior of the second notched section 46 of the rear sole 28. The alignment dimples 43 are sized to fit within and mate with the nipples 41 when the two sections are assembled, to help align the two sections, to help provide structural stability generally, and specifically to prevent a twisting of the rear sole in a horizontal plane within the recess 40 when the user pivots on the heel of the shoe.

Also shown in FIG. 1 is a preferred embodiment for a plurality of resilient cleats 36, detachably secured to the forward sole 24. The cleats are discussed in greater detail below.

Figure 2:
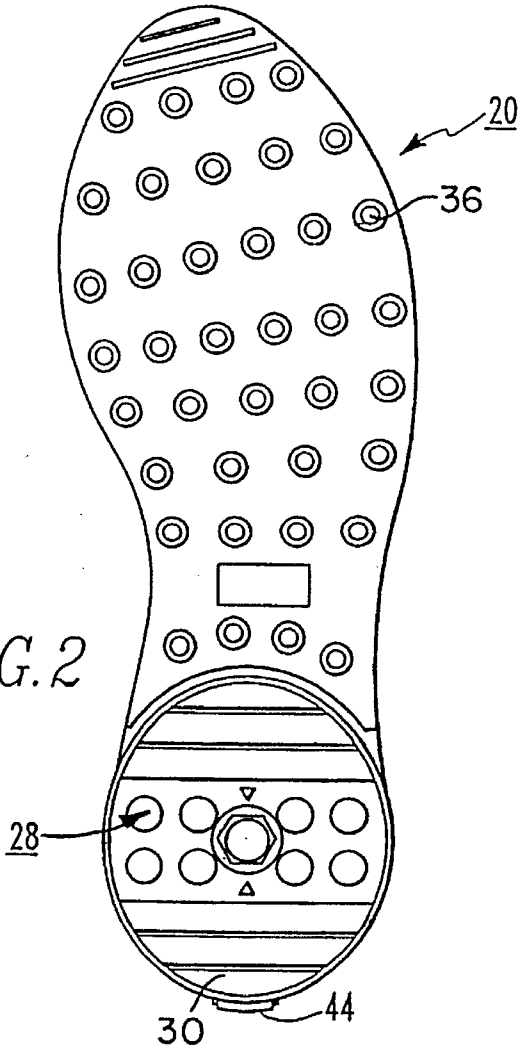
FIG. 2 is a plan view of an improved athletic shoe sole.

FIG. 2 is a plan view of an embodiment of an improved athletic shoe 20 and depicts the ground engaging surface 30 of the rear sole 28 and the resilient cleats 36.

Figure 3:
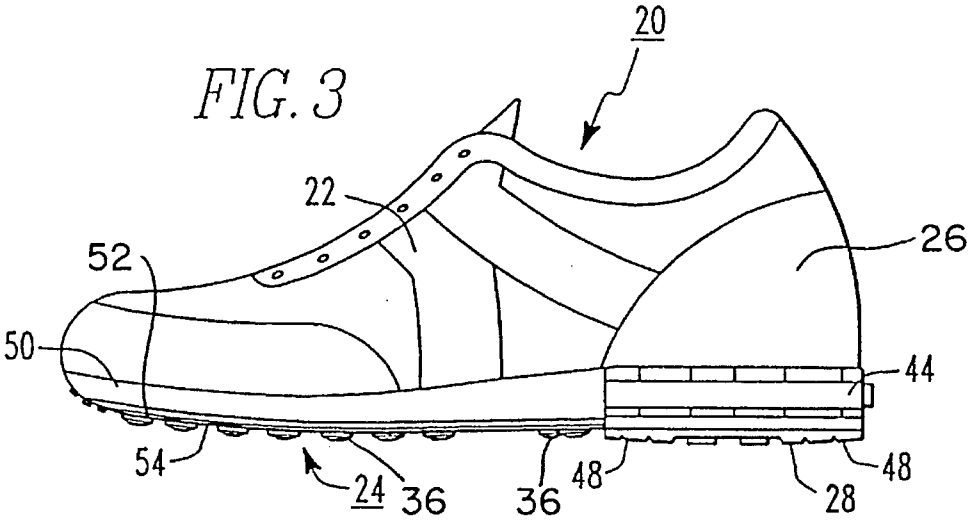
FIG. 3 is a side elevation view of an improved athletic shoe sole.

FIG. 3 depicts a side view of an improved athletic shoe 20, where the beveled edges 48 of the ground engaging surface, as per a running shoe model, again are depicted.

Figure 4:
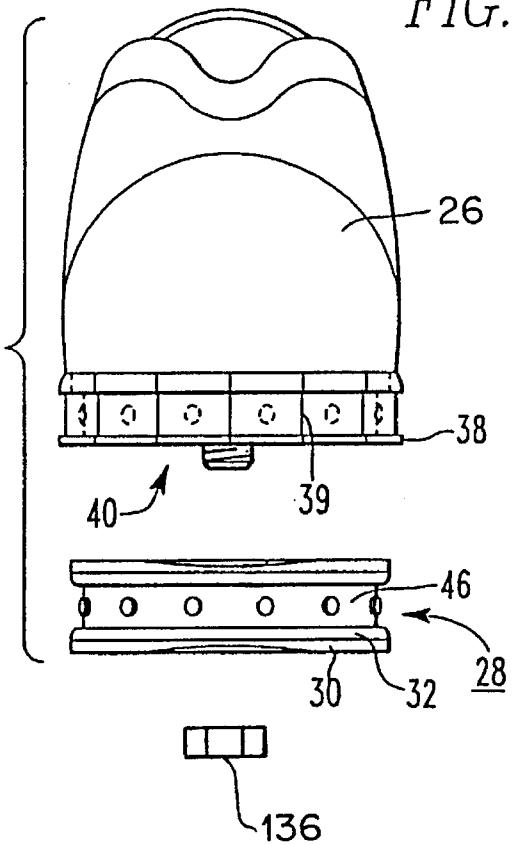
FIG. 4 is a rear elevation view of an improved athletic shoe sole.

FIG. 4 is a rear elevation of the heel support 26 and the rear sole 28, and depicts a preferred embodiment for attaching the two sections whereby the rear sole is both detachable and rotatable. The band 44, as shown in FIG. 1, is not shown in FIG. 4, although it could be included as an option.

Figure 5:
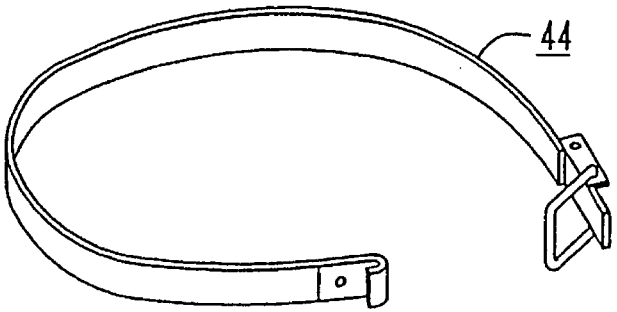
FIG. 5 is an expanded view of a securing band and clamping means for one embodiment of an improved athletic shoe sole.

FIG. 5 shows an expanded view of the securing band 44. The clamping assembly is similar to the conventional latch and clasp system used on most ski boots and similar equipment. The latch pivots from a first position, where the clasp is engaged, to a second and locking position, which forces the two ends of the assembly together. Similar clamping assemblies are well-known in the industry, e.g., radiator hose clamps, etc. could be used and still achieve the benefits of this invention.

Figure 6:
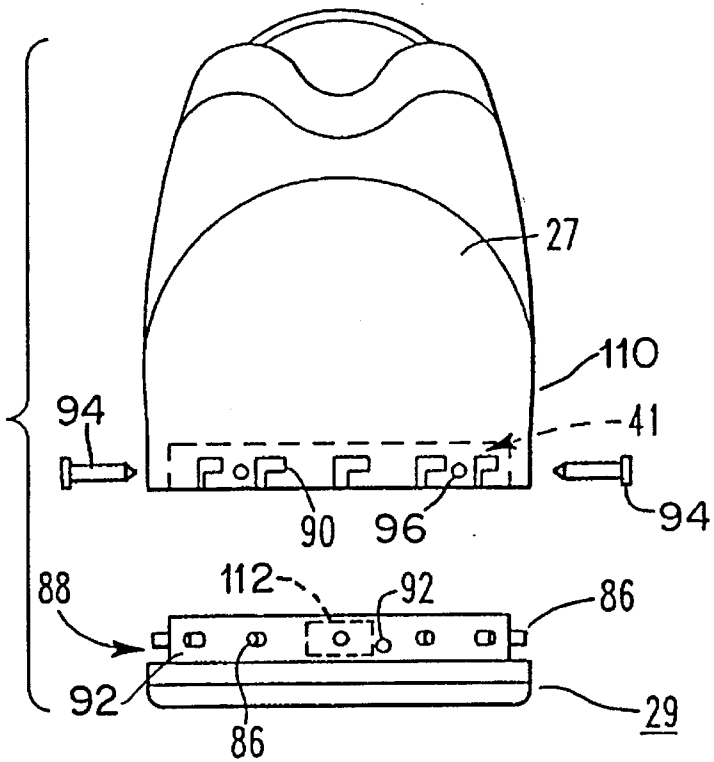
FIG. 6 is a rear elevation view of another embodiment of a means for detachably securing the rear sole to an improved athletic shoe.

In another embodiment shown in FIG. 6, the securing means is achieved by a rear sole 29 having a plurality of spaced-apart protrusions 86 located along the periphery of a top mating surface 88 of the rear sole 29. The protrusions 86 are sized to mate with a plurality of inverted "L"-shaped slots 90 located in a recess 41 of a heel support 27. The slots are sized to receive the protrusions such that the rear sole is mated to the heel support by inserting the rear sole and protrusions up within the heel support recess, and rotating the rear sole about an axis normal to the major axis of the shoe to lock the protrusions into a horizontal segment of the inverted "L"-shaped slots. To further lock the rear sole into place and also to then prevent undesired rotation of the rear sole 29 within the recess 41 when the user pivots on the heel, set screws 94 such as shown in FIG. 6 could be employed. More particularly, such set screws would penetrate the wall of the heel support in between the inverted "L" shaped slots as shown in FIG. 6 and engage the threaded apertures 92 in the rear sole 29.

Finally, FIG. 6 also depicts an optional centering post 110, located within the recess 41, that is sized to mate with a resilient centering aperture 112 located on a top surface of the rear sole 29. The top portion of the centering post has a diameter larger than the diameter of the centering aperture so that the rear sole will be detachably secured when pressed up and mated with the heel support.

The means for locking or securing the rear sole to the heel support is not limited. A secure and tight fit is required, but also the means must be easily accomplished so the user will not be required to return the shoe to the manufacturer or a shoe repair store in order to replace or remove the rear sole.

The ability to remove the rear sole serves several purposes. The user can rotate and/or invert the rear sole to relocate a worn section to a less critical area of the sole, and eventually replace the rear sole altogether when the sole is excessively worn. However, some users will prefer to change the rear soles not because of adverse wear patterns, but because of a desire for different performance characteristics. For example, it is contemplated that a person using this invention in a shoe marketed as a "cross-trainer" may desire one type of rear sole for one sport, such as basketball, and another type of rear sole for another, such as running. A basketball player might require a harder and firmer rear sole for stability where quick, lateral movement is essential, whereas a runner or jogger might tend to favor increased shock absorption features achievable from a softer, more cushioned heel. Similarly, a jogger planning a run outside on rough asphalt or cement might prefer a more resilient rear sole than the type that would be suitable to run on an already resilient indoor wooden track.

While the above discussion is directed towards a rear sole that rotates or separates in its entirety, it is specifically contemplated that the same benefits of this invention can be achieved if only a portion of the rear sole is rotatable or removable. In this respect, "at least one rotatable ground engaging surface" means that at least one surface of the rear sole, that contacts the ground during use, rotates or is removable. For example, this invention includes the embodiment whereby a portion of the rear sole, e.g., the center area, remains stationary while the periphery of the ground engaging surface rotates and/or is detachable.

Figure 7:
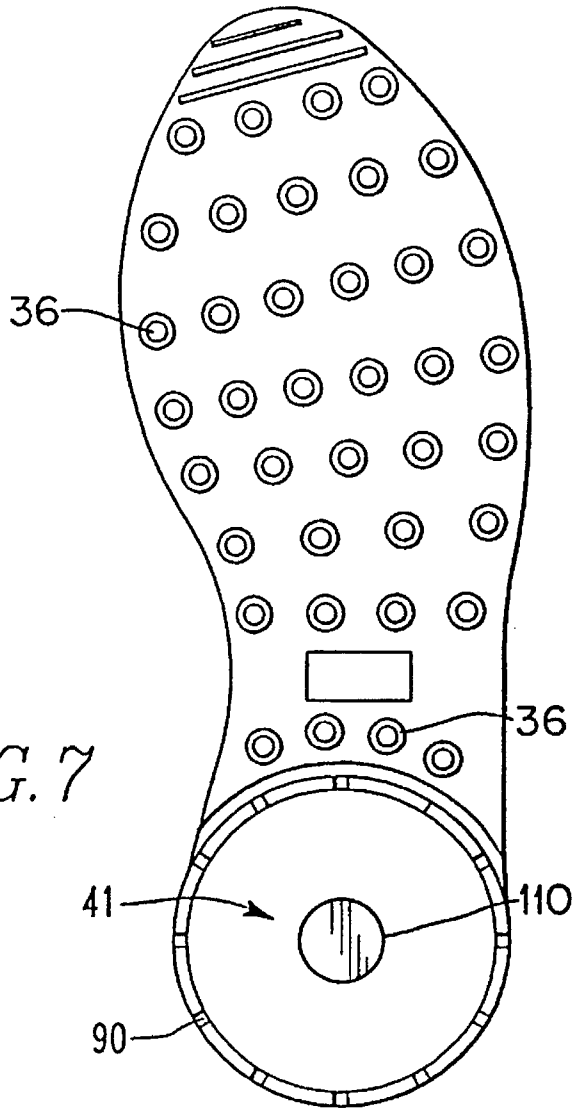
FIG. 7 is a plan view of the embodiment shown in FIG. 6.

FIG. 7 is a plan view of the athletic shoe of FIG. 6, without the rear sole 29, but showing the recess 41.

Returning to FIG. 3, an athletic shoe upper 22, a forward sole 24, a forward midsole 50, a base layer 52, and an outersole 54 are depicted. The forward midsole 50 is attached to the upper, in conventional fashion, e.g., injection molding or gluing, etc. The base layer 52 is attached to the forward midsole 50, and the outersole 54 is attached to the base layer 52, in similar conventional fashion known to those skilled in the art.

The base layer 52 should be fashioned from a stiff, but flexible material, such as plastic, fiberglass, hard urethane, hard rubber or a suitable composite material. The base layer lies between the forward midsole 50 and the outersole 54 of the forward midsole. It is envisioned that the base layer thickness will be approximately 1/32" to 1/8" thick. The estimated thickness of the outersole 54, forward of the rear sole, also will be 1/32" to 1/8", exclusive of cleats or protective mounds. The base layer need not be solid throughout; rather, it could have holes or perforations, or even a weave pattern, just so long as there is base layer wherever there is a mating post 64 (as shown in FIG. 8A) and above each resilient cleat 36.

FIGS. 8 through 11 depict different embodiments of methods of attaching the resilient cleats.

The cleats 36 preferably are made of an appropriate shock-absorbing, material of greater hardness than the forward midsole 50. The material is likely to be rubber but could be other moldable, resilient, polymeric material. The cleats are removable and replaceable so that the user can replace the worn cleats with new cleats without returning the shoe to the manufacturer or shoe repair store. Also, the user may elect to use cleats with different properties depending upon the desired performance characteristics, similar to the versatility provided with the replaceable rear sole concept. The shape of the resilient cleat 36 and the ground contacting surface 58 is not limited, and may be circular, polygonal, or otherwise. As shown in the embodiment of FIG. 8A, the cleat contains a cavity 56, a ground contacting surface 58, a throat 60 and an enlarged inside area 62. A mating post 64 contains a bulbous end portion 66 and a neck 68. The cavity 56 is sized to mate with the bulbous end portion 66. The post 64 is integrally formed on the base layer 52 and protrudes through a corresponding protrusion of the outersole 54. The bulbous end portion 66 has a larger diameter than the throat 60 diameter, and the throat 60 expands to allow the passage of the bulbous end portion of the post and then contracts as the bulbous end portion 66 enters the cavity 56. Also shown are the protective mounds 55 of the outersole which surround and protect the cleat, providing horizontal and vertical stability.

The volume of the enlarged inside area 62 is larger than the volume displaced by the bulbous end portion 66 of the post 64. This allows for the load pressed against the cleat when the shoe contacts with the ground to be spread more evenly over the top surface 70 of the cleat 58, as opposed to having the majority of the load concentrated on the top of the post 64.

Figure 8B:
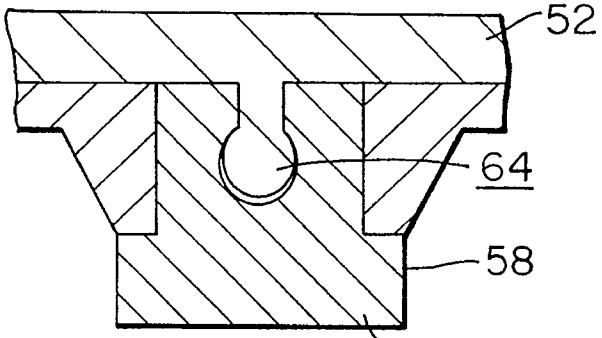
FIGS. 8A and 8B show an exploded view and an assembled view, respectively, of one embodiment of a replaceable cleat.
Figure 8A:
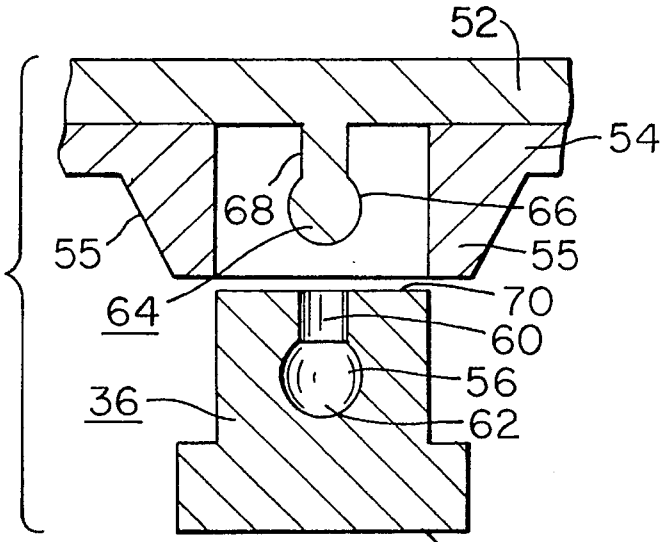

FIG. 8B depicts the cleat embodiment of FIG. 8A in the assembled position.

Figure 9:
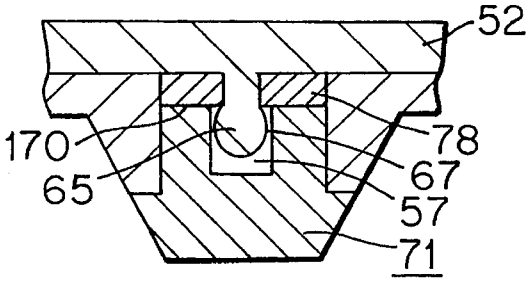

FIG. 9 shows an embodiment whereby the top surface 170 of a cleat 71 is attached to a ring 78 which is aligned over a bore 57 within the cleat. The exterior size or diameter of such ring is the same as the size or diameter of the cleat to which it is attached, preferably with an adhesive. The ring preferably is made of the same resilient material as the post 65 (and base layer 52) to ensure that the post "snaps" into a secure fit when engaged. The diameter of the bulbous end of the post 65 is greater than the inner diameter of the ring 78. Depending upon the relative hardness of the materials, the inner diameter of the ring 78 can expand to allow the passage of the bulbous end portion 67 and then contract as the bulbous end portion 67 enters the bore 57. The depth of the bore 57 creates a greater inside volume than the volume displaced by the bulbous end portion 67, for load distribution purposes as heretofore discussed. This action also allows the cleat to be detachably secured upon the post during use.

Figure 10:
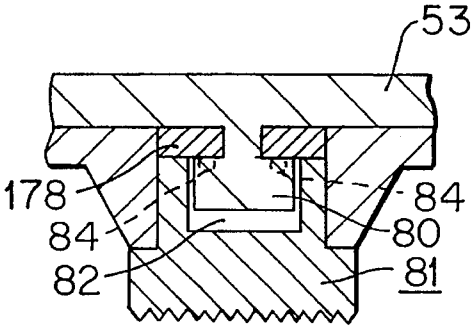

FIG. 10 shows an embodiment where the post formed on base layer 53, has an oblong end 80. This embodiment employs a ring 178 with an interior opening that is oblong and sized to receive the oblong end 80. The cleat 81 has a circular bore 82 of a diameter at least the size of the greatest width of the oblong end 80. The surface of the ring 178 adjoining the cleat 81 in this embodiment has four raised nipples 84. When the cleat is inserted over the post in this embodiment, the cleat is "snapped" over the post, and then turned one-quarter turn. The two raised nipples 84 on each side of an oblong end aid in "locking" the post into place by acting as stops to preclude the cleat from turning back and "unlocking." In this embodiment, the ground contacting surface 59 of o the cleat could have a distinctive marker or seam somewhere in its outer periphery to allow the wearer to confirm by visual inspection that the cleat is indeed "locked." This will allow the user to know at a glance that all cleats are "locked" if all markings or seams are oriented in the same direction on the sole.

Figure 11:
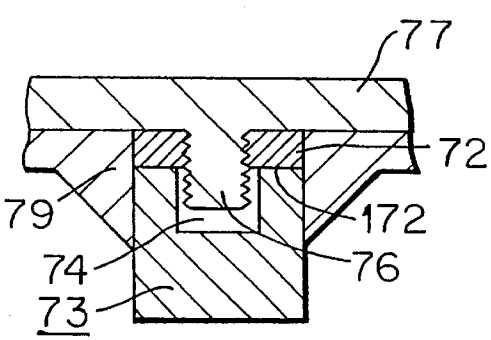
FIGS. 9 through 11 depict several additional embodiments of replaceable cleats for an improved athletic shoe sole.

FIG. 11 depicts another embodiment of the resilient cleats. A threaded nut 72 attaches to the top surface 172 of the cleat 73. The aperture of the nut is threaded and aligned over the opening to a bore 74. The post 76, molded onto the base layer 77, is threaded in this embodiment, allowing for the cleat to be screwed on for a secure fit. An embodiment of the outersole protective mounds 79 is shown surrounding the cleat.

In all of the above embodiments, the optimum width or diameter of the cleats appears to be in the 3/8" to 5/8" range. In terms of cleat height (including outer sole layer), 1/4 to 3/8" appears optimum. The preferred height of the ring 78 and nut 72 ranges from 1/32" to 1/16".

Also shown in FIGS. 8 through 11 are different embodiments of the mounds and the ground contacting surface of the cleat. Those skilled in the art can discern these various embodiments from a close scrutiny of these figures.

Figure 12A:
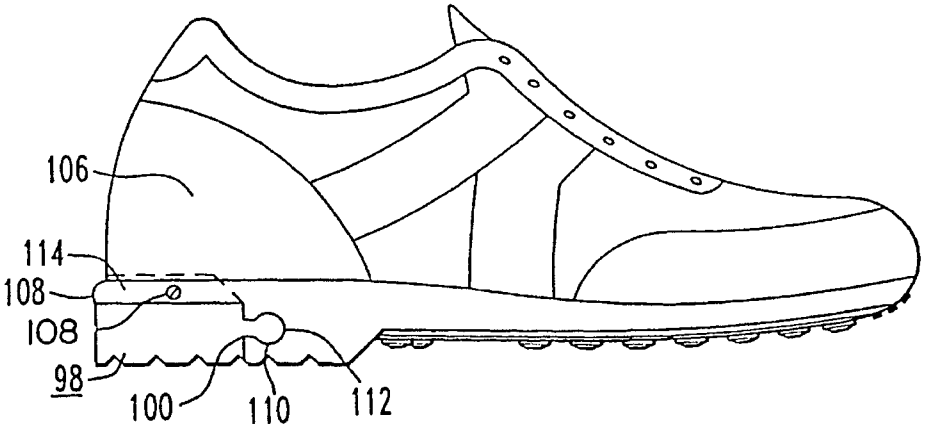
FIGS. 12A and 12B depict an additional embodiment of a replaceable rear sole.
Figure 12B:
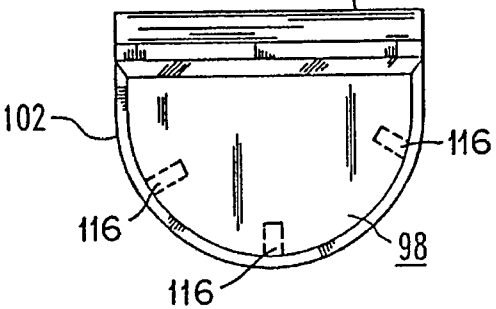

In FIGS. 12A and 12B, another embodiment of an improved athletic shoe sole is shown. This figure depicts a rear sole 98 that has a transverse edge 100 and a peripheral edge 102. A tongue 110 and groove 112 mechanism secures the transverse edge 100 of the rear sole 98 to allow the rear sole to first engage the heel support 106. The tongue 110 in the embodiment shown in FIG. 12A extends the entire distance of the transverse edge 100. To assemble, the user slides the rear sole 98 in transversely to the major axis of the shoe. (Alternatively, the tongue 110 may be designed to "snap" into the groove 112 by inserting the rear sole from the rear of the shoe and directly into the groove 112.) The user then swings the rear sole 98 up to the heel support 106, using a means for securing the rear sole to the heel support so that the rear sole is securely attached. To disassemble, the process is reversed. The means for securing the rear sole is not limited; alternatives can include any of the securing means described herein, or as used conventionally in analogous applications. Alternatives can, of course, include integral locking mechanisms all around the outer periphery of the heel, or a plurality of set screws 108 which pass through an overhanging portion 114 and secure to a corresponding number of threaded receiving apertures 116 of the rear sole 98. The existence of an overhanging portion 114 may require the tongue 110 to be made of a resilient material so that the rear sole 98 can bend downwards and clear the overhanging portion 114 during assembly or disassembly. Other alternative locking mechanisms, such as the "snapping" centering post of FIG. 7, the threaded post of FIG. 1, etc., as described herein, could be employed.

It is important to note that the rear sole of the improved athletic shoe sole of FIGS. 12A and 12B can be oriented in several different manners and still be an embodiment of this invention. The transverse edge 100 and tongue 110 may be angled in the plane of the outersole of the shoe so that they are non-perpendicular to the major axis of the shoe. This orientation will allow for a greater amount of surface contact between the tongue 110 and groove 112 than achievable if the transverse edge 100 and tongue 110 are oriented, within the plane of the outer sole, perpendicularly to the major axis of the shoe as shown in FIGS. 12A and 12B. Such orientation will also permit the isolation of the wear spot which typically occurs on the outer periphery of the heel of most runners within a smaller, removable rear sole element. A transverse edge with a different angle would achieve the same purpose for runners who tend to pronate. Also, although FIG. 12A depicts the tongue 110 extending out from the rear sole along an axis which is parallel to the major axis of the shoe, the tongue could instead extend upwards or downwards at an angle to the major axis of the shoe, and still fall within the invention described herein. In addition, the rear sole 98 need not extend, from the rear of shoe forward, the full horizontal distance of the portion of the shoe commonly referred to as the "heel portion"; rather, the benefits of this invention are achieved if, as shown in FIGS. 12A and 12B, the rear sole includes only a segment of such "heel portion". Finally, the rear sole 98 of FIGS. 12A and 12B could be rotatable about an axis aligned with the shoe's major axis, just as in the other embodiments discussed above. This feature allows the user to disengage the rear sole, "invert" or flip the rear sole about the shoe's major axis, and then re-engage the rear sole to the shoe. Consequently, the "heel strike" portion of the rear sole could be changed in this fashion.

The above description of the preferred embodiments thus details many ways in which the present invention can be used. While several preferred embodiments are described in detail hereinabove, it is apparent that various changes might be made without departing from the scope of the invention, which is set forth in the accompanying claims. Other embodiments of the invention will be apparent to those skilled in the art from a consideration of the invention disclosed herein.

I claim:

1. A shoe comprising:

an upper;

a forward sole attached to the upper;

a heel support attached to the upper and having at least one wall extending downwardly from the upper that at least partially defines a recess, the wall including a notched section oriented generally horizontally and extending along the periphery of the wall;

a rear sole receivable in the recess of the heel support; and a securing band receivable in the notched section and sized to fit around the wall to compress the wall against the rear sole to retain the rear sole in the recess.

2. The shoe of claim 1 wherein the shoe is designed principally for running, jogging or walking as a form of exercise or competition.

3. The shoe of claim 1 wherein the rear sole is symmetrical about at least one axis.

4. The shoe of claim 1 wherein:

the wall includes a plurality of compression slits oriented generally vertically around the periphery of the wall.

5. The shoe of claim 4 wherein the securing band includes two ends; an open position; a closed position; a first rigid member and a second rigid member, the first rigid member is attached to and pivots about one end of the securing band; the second rigid member is attached to and pivots about the other end of the securing band; the second rigid member is pivotally attached at its other end to the first rigid member at a point other than either end of the first rigid member; the open position defined to be the orientation of the first and second rigid member resulting in the securing band having its largest periphery; and the closed position defined to be the orientation of the first and second rigid member resulting in the securing band having its smallest periphery and slightly less than the periphery of the notched section of the heel support.

6. The shoe of claim 1 further comprising a plurality of dimples located on one of the wall of the heel support and a peripheral surface of the rear sole and generally oriented horizontally; and a plurality of nipples located on the other of the wall and the peripheral surface also generally oriented horizontally; the nipples sized to mate within the dimples when the rear sole is assembled with the heel support.

7. The shoe of claim 1 wherein the rear sole includes a ground-engaging surface that is non-planar.

8. The shoe of claim 7 wherein the ground-engaging surface has at least a back edge that is tapered.

9. The shoe of claim 1 wherein the rear sole includes a ground-engaging surface that is symmetrical about at least one axis.

10. The shoe of claim 9 wherein the rear sole is rotatable about an axis aligned with the major axis of the shoe.

11. The shoe of claim 9 wherein the rear sole is rotatable about an axis normal to the major axis of the shoe.

12. The shoe of claim 1 further comprising a plurality of resilient cleats detachably secured to the forward sole.

13. The shoe of claim 12 where the forward sole comprises a midsole, a base layer attached thereto; an outersole attached to the base layer and containing a plurality of openings; a plurality of resilient posts integrally formed onto the base layer and extending downwardly through the outersole openings; each of the cleats containing a cavity which is sized to receive the posts; and an engaging means so that the cleats are detachably secured to the post formed on the base layer.

14. A shoe comprising:

an upper;

a forward sole attached to the upper;

a heel support attached to the upper and having at least one wall extending downwardly from the upper that at least partially defines a recess, the wall including a plurality of compression slits oriented generally vertically around the periphery of the wall;

a rear sole receivable in the recess of the heel support; and a securing band sized to fit around the wall to compress the wall against the rear sole to retain the rear sole in the recess.

15. A shoe comprising:

an upper;

a forward sole attached to the upper;

a heel support attached to the upper and having at least one wall extending downwardly from the wall that at least partially defines a recess;

a rear sole receivable in the recess of the heel support and having a ground-engaging surface that is symmetrical about at least one axis, the rear sole rotatable about an axis aligned with the major axis of the shoe; and a securing band sized to fit around the wall to compress the wall against the rear sole to retain the rear sole in the recess.

* * * * *